United States Patent [19]

Asano

[11] 4,309,841

[45] Jan. 12, 1982

[54] TWO-WHEEL TOY VEHICLE WITH INERTIA FLYWHEEL

[75] Inventor: Kiyoji Asano, Tokyo, Japan

[73] Assignee: Shinsei Kogyo Company, Ltd., Tokyo, Japan

[21] Appl. No.: 220,103

[22] Filed: Dec. 24, 1980

[30] Foreign Application Priority Data

Dec. 28, 1979 [JP] Japan ..... 54-184338[U]
Feb. 19, 1980 [JP] Japan ..... 55-20120[U]

[51] Int. Cl.[3] ..... A63H 17/16; A63H 29/20
[52] U.S. Cl. ..... 46/209
[58] Field of Search ..... 46/201, 202, 206, 209

[56] References Cited

U.S. PATENT DOCUMENTS 3,886,682 6/1975 Ieda ..... 46/209 X
4,130,963 12/1978 Ohashi ..... 46/209
4,267,663 5/1981 Nagahara ..... 46/262 X

FOREIGN PATENT DOCUMENTS 747034 3/1956 United Kingdom ..... 46/209
1408986 10/1975 United Kingdom ..... 46/202

*Primary Examiner*—F. Barry Shay
*Attorney, Agent, or Firm*—Staas & Halsey

[57] ABSTRACT

A two-wheel toy vehicle, having a body, preferably, in the replica of a motorcycle, and an inertia energy flywheel and transmission gear mechanism for driving the vehicle (through the rear wheel) in a forward movement in both a one-wheel upwardly-extended position and a two-wheel position along the running surface. A shock-absorbing device is formed as part of the transmission gear mechanism for absorbing sudden shock forces between the flywheel and the rear wheel driven by the flywheel. In addition, the front wheel is rotatably mounted to the vehicle and in a manner for lateral movement. However, a device is formed on the front portion of the toy vehicle to limit the lateral movement of the front wheel to ensure that the vehicle is balanced and maintained in its one-wheel upwardly-extended position and when it falls from this one-wheel position to its two-wheel position along the running surface.

21 Claims, 7 Drawing Figures

FIG. 5.
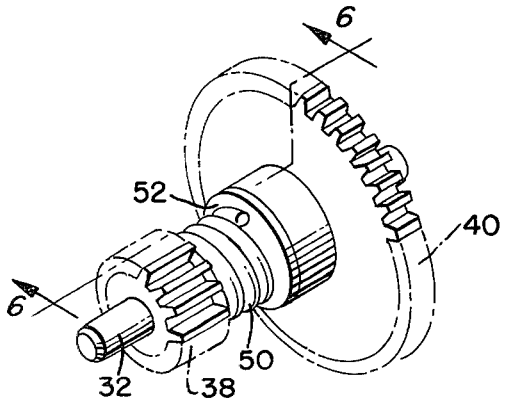
FIG. 6.
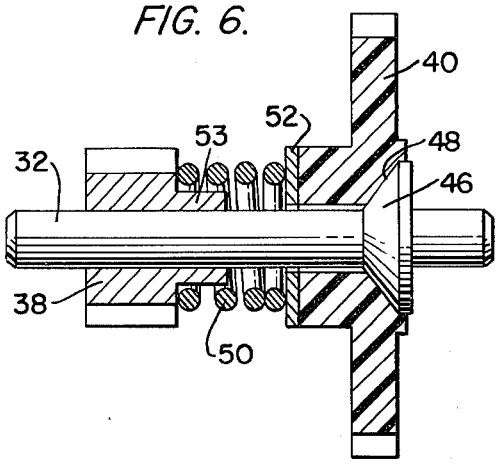
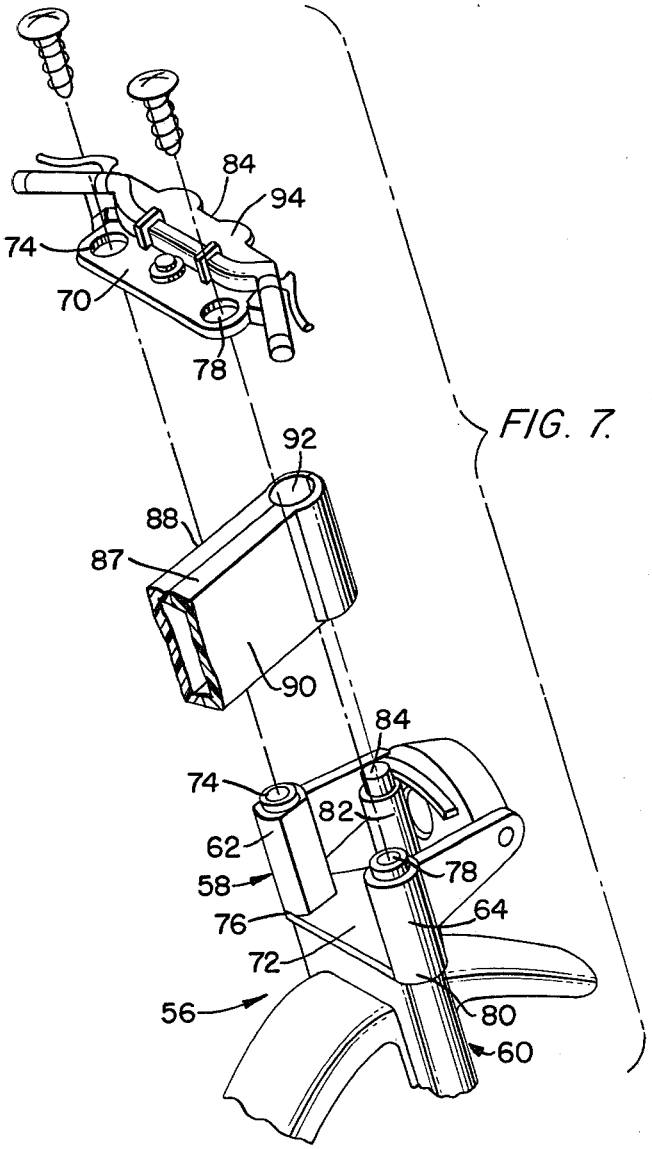
FIG. 7.

TWO-WHEEL TOY VEHICLE WITH INERTIA FLYWHEEL

BRIEF SUMMARY OF THE INVENTION

The present invention relates to a toy vehicle and, more particularly, to a two-wheel toy vehicle having an inertia energy flywheel storage and transmission mechanism and a forward driven movement in both a one-wheel upwardly-extended position and a two-wheel position along the running surface.

The objects of this invention are to provide a toy vehicle which is amusing and entertaining, which is durable, reliable, safe, and able to withstand rough play, and one which has components easily assembled and simple in construction to allow low cost, high-volume production and which is economical and competitive with existing toys. Further objects of this invention are to provide a two-wheel toy vehicle in the replica of a motor cycle and simulating movement in what is commonly referred to as a "wheelie" action.

Additional objects and advantages of the invention will be set forth in part in the description which follows, and in part will be obvious from the description, or may be learned by practice of the invention.

To achieve the foregoing objects and in accordance with one aspect of the invention, as embodied and broadly described herein, there is provided a two-wheel toy vehicle comprising: (1) a body having a rear portion engageable with a running surface for guiding the vehicle in a forward movement along the running surface in a one-wheel upwardly-extended position; (2) front and rear wheel axles mounted on the body; (3) a first wheel freely rotatably mounted on the front axle and a second wheel rotatably mounted on the rear axle for driving the toy vehicle in both a one-wheel upwardly-extended position and a two-wheel position along the running surface; and (4) inertia energy storage and drive means mounted within the body and operatively connected to the rear wheel for activation by the rotation of the rear wheel and for driving the toy vehicle through the rear wheel, wherein the vehicle is driven forwardly in a one-wheel upwardly-extended position when the driven rear wheel and the rear portion of the vehicle body are engaged on the running surface and wherein the front wheel of the vehicle returns to the running surface when the stored inertia energy diminishes, the vehicle thereby moving forwardly in a normal two-wheel position.

In a preferred embodiment of the toy vehicle, there is provided means for mounting the front wheel to the vehicle body for limited lateral movement, wherein the vehicle body has a main body frame on which the rear wheel is rotatably mounted and a front body portion pivotally mounted to the main body frame for lateral movement and on which the front wheel is rotatably mounted. The front wheel mounting and limiting means includes first and second substantially parallel shafts having lower ends on which the front wheel axle is mounted therebetween, a pair of triangular plate members mounted to upper ends of the pair of shafts transverse thereto, the shafts being attached to the corresponding back apex points of each triangular plate member, and a third shaft formed between the triangular plate members at the corresponding front apex points thereof substantially parallel to the first and second shafts and rotatably mounted to the main body for lateral movement of the front body portion. Preferably, the main body frame extends between the first and second shafts to the third shaft for mounting the shaft thereto and wherein the first and second shafts abut corresponding sides of the main body frame for limiting lateral movement of the front body portion.

In yet a further preferred embodiment of the toy vehicle, there is provided means for absorbing transmission shock forces between an inertia energy storage and drive flywheel rotatably mounted within the body and the rear wheel to which the flywheel is operatively connected. Preferably, this shock-absorbing means is formed as part of transmission gear means which operatively connects the flywheel with the rear wheel and comprises a center transmission shaft rotatably mounted in the body and having a conical convex portion at one end, a first gear operatively connected to the rear wheel and fixedly mounted to the center shaft at the opposite end to the convex portion, a second gear operatively connected to the intertia flywheel, rotatably mounted on the center shaft and having a conical concave portion frictionally engageable with the conical convex portion of the center shaft, and a spring positioned between the first and second gears for urging the concave and convex portions into frictional engagement.

BRIEF DESCRIPTION OF THE DRAWINGS

The accompanying drawings, which are incorporated in and constitute a part of this specification, illustrate an embodiment of the invention and, together with the description, serve to explain the principles of the invention.

FIG. 5 is a perspective view of the shock-absorbing means which is formed as a part of the transmission gear means for a preferred embodiment of the toy vehicle, in accordance with the invention;

FIG. 6 is a cross-sectional view of the shock-absorbing means shown in FIG. 5, taken along the line 6—6 in FIG. 5; and FIG. 7 is an exploded partially-fragmented perspective view of the means for mounting the front wheel to the body of the toy vehicle for limited lateral movement for a preferred embodiment of the toy vehicle, in accordance with the invention.

DETAILED DESCRIPTION OF THE PREFERRED EMBODIMENT

Reference will now be made in detail to the present preferred embodiments of the invention, an example of which is illustrated in the accompanying drawings.

Figure 1:
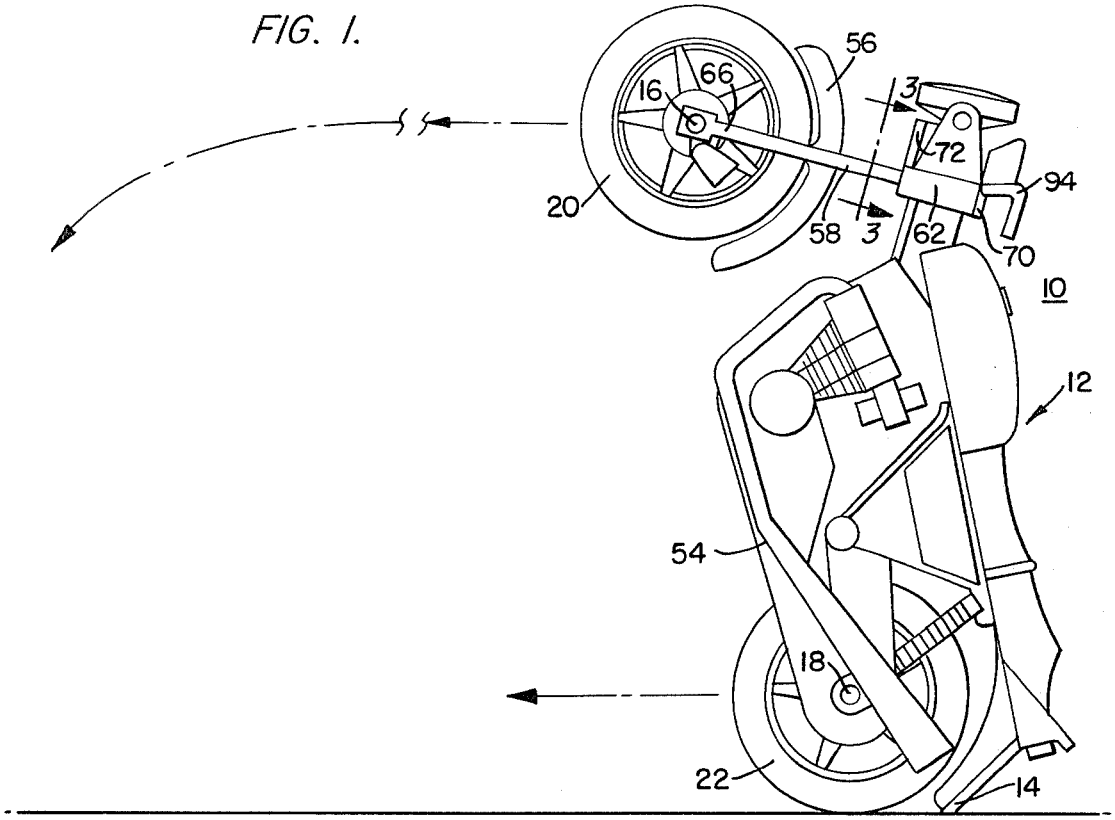
FIG. 1 is a side-view of a preferred embodiment of a two-wheel toy vehicle in accordance with the invention in the replica of a motorcycle, illustrating the toy vehicle in a one-wheel, upwardly-extended position when the driven rear wheel and the rear portion of the vehicle body are engaged on the running surface.
Figure 2:
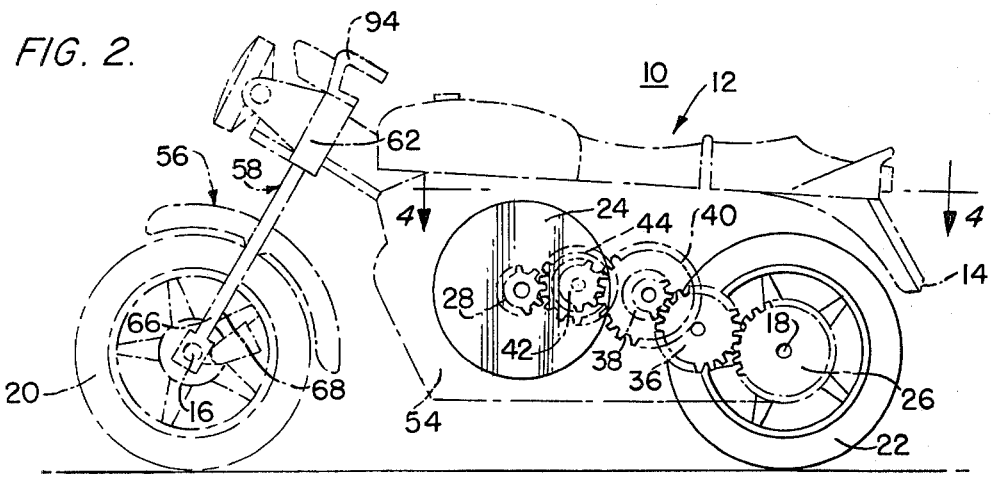
FIG. 2 is a cross-sectional side view of the toy vehicle of FIG. 1, illustrating the vehicle in a two-wheel position when the front wheel of the vehicle returns to the running surface from its upwardly-extended position after the stored inertia energy of the flywheel diminishes, and further illustrating the inertia energy flywheel and transmission gear means for driving the rear wheel of the toy vehicle.

In accordance with the invention, and as shown in FIGS. 1 and 2, the toy comprises a two-wheel toy vehicle, commonly designated by the reference numeral 10, which can be imparted with movement in a one-wheel upwardly-extended position and a two-wheel position along a running surface. As embodied herein, this two-wheel toy vehicle comprises a vehicle body 12, preferably in the replica of a motor cycle, having a rear portion 14 engageable with the running surface for guiding the toy vehicle in a forward movement along the running surface in a one-wheel upwardly-extended position (commonly referred to as "wheelie" action). This above-noted movement and position are best seen in FIG. 1. Preferably, when the two-wheel toy vehicle is configured in the replica of a motorcycle, the rear portion 14 is formed as a tip of the motorcycle rear fender (see FIG. 1). Front and rear wheel axles 16 and 18, respectively, are mounted on the toy vehicle body 12 with a front wheel 20 being freely rotatably mounted on the front axle 16 and a rear wheel 22 being rotatably mounted on the rear axle 18 for driving the toy vehicle in both the one-wheel upwardly-extended position and the two-wheel position along the running surface.

Figure 4:
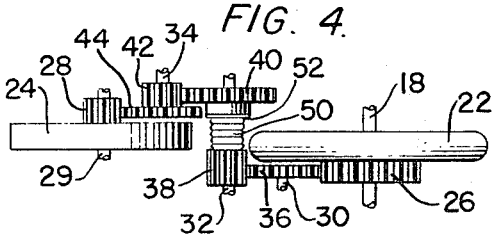
FIG. 4 is an enlarged top view of the toy vehicle of FIG. 1, taken along the line 4—4, illustrating in particular the transmission gear means, and the transmission shock-absorbing means which forms a part of the transmission gear means, which operatively connects the inertia energy flywheel with the rear wheel of the toy vehicle.

In accordance with the invention, the toy vehicle 10 further comprises a self-contained inertia energy storage and drive means for imparting driving movement to the vehicle. As embodied herein, and as best shown in FIGS. 2 and 4, the inertia energy storage and drive means includes an inertia energy flywheel 24 rotatably mounted within the vehicle body 12 and operatively connected to the rear wheel 22 for activation by the rotation of the rear wheel 22 and for driving the toy vehicle through the rear wheel 22. Thus, when the flywheel is imparted with rotational movement and when the rear wheel 22 and the rear portion 14 of the vehicle body 12 are placed on the running surface, the vehicle is driven forwardly in the one-wheel upwardly-extended position. When the stored rotational movement of the flywheel 24 diminishes, the front wheel 20 of the toy vehicle 10 falls back onto the running surface so that the vehicle thereby moves forwardly in a two-wheel position. To impart the proper change in positioning and forward movement of the toy vehicle from the one-wheel upwardly-extended position to the two-wheel position when stored inertia energy of the flywheel 24 diminishes, the flywheel 24 is mounted preferably within the vehicle body 12 slightly closer to the rear wheel 22 relative to the front wheel 20, but mounted within the vehicle body 12 slightly forward of the rear wheel 22 when the rear body portion 14 and the rear wheel 22 engage the running surface and the vehicle 10 is in the one-wheel upwardly-extended drive position.

As embodied herein, the toy vehicle 10 further comprises transmission gear means for transmitting rotational movement between the inertia flywheel 24 and the rear wheel 22. The gear means preferably connects the inertia flywheel 24 and the rear and the rear wheel 22 together for rotation in the same direction. As best seen in FIGS. 2 and 4, the transmission gear means includes a gear 26 fixedly connected to the rear wheel 22 adjacent one side thereof for rotation with the rear wheel about the rear axle 18; a gear 28 fixedly connected to the inertia flywheel 24 adjacent one side thereof for rotation with the flywheel about a shaft 29 mounted in the vehicle body 12; gear axles 30, 32, and 34 mounted within the vehicle body 12; and gears 36, 38, 40, 42, and 44 mounted on the various gear axles 30, 32, and 34. More specifically, the gear 36 is mounted on the gear axle 30 and is meshed with the gear 26. The gears 38 and 40 are commonly mounted on the gear axle 32, with the gear 38 meshed with the gear 36. The gears 42 and 44 are commonly mounted on the gear axle 34, with the gear 42 meshed with the gear 40 and the gear 44 meshed with the gear 28.

As best seen in FIG. 4, the previously-described gears 26, 36, and 38 are mounted transversely to the inertia flywheel 24 and the rear wheel 22 at one side within the vehicle body 12 and the gears 28, 40, 42, and 44 are mounted transversely to the flywheel 24 and the rear wheel 22 at the opposite side within the vehicle body 12. Thus, it will be seen that the above configuration of the transmission gear means is significant for the embodiment of this two-wheel vehicle because it allows ready and simple use of a transmission shock-absorbing means, as described hereinafter, and provides balance within the two-wheel toy vehicle for the operating components so that the toy vehicle can be imparted with proper movement in the previously described one-wheel upwardly-extended position ("wheelie" action) and return to the two-wheel position along the running surface.

In an inertia-energy flywheel type toy vehicle, such as described hereinabove, it has been found preferable to provide means for absorbing transmission shock forces between the flywheel 24 and the rear wheel 22 to prevent slippage in the transmission drive forces or to prevent shock due to sudden stoppage of the rear wheel or the like from damaging various operating components of the toy vehicle, and in particular the transmission gear means. In addition to the foregoing, it has also been found preferably to form the shock-absorbing means as part of the transmission gear means for simplicity and to minimize the size of the toy vehicle.

In the embodiment of the shock-absorbing means shown in FIGS. 4, 5, and 6, the transmission gear axle 32 comprises a center transmission shaft which is rotatably mounted in the vehicle body 12 between the flywheel 24 and rear wheel 22 and has a conical convex portion 46 formed at one end thereof. The transmission gear 38 is fixably mounted to the center shaft axle 32 at the opposite end to the conical convex portion 46. The transmission gear 40, on the other hand, is rotatably mounted on the same center shaft axle 32 and has a conical concave inner side portion 48 which is frictionally engageable with the conical convex portion 46 of the center shaft 32. Thus, in accordance with the invention, the shock-absorbing means is formed as a part of the transmission gear means and includes the second gear axle 32 with convex portion 46, the gear 38, and the gear 40 with concave portion 48. As embodied herein, the shock-absorbing means further comprises a spring 50 which is positioned between the gears 38 and 40 for urging the convex and concave portions 46 and 48, respectively, into frictional engagement with one another. This spring 50 provides a pre-described value of frictional force between the convex and concave portions 46 and 48 not only to allow transmission of driving forces between the flywheel 24 and the rear wheel 22 but also to absorb sudden transmission force shocks therebetween. In other words, when the flywheel 24 is put into rotational movement by placing the rear wheel 22 on the running surface and pushing the toy vehicle body 12 forwardly, the gear 40 functions to transmit this rotational movement to the flywheel 24 without slipping when the vehicle is driven forwardly normally in either its one-wheel upwardly-extended position or its two-wheel position. However, if, for example, the drive gear 26 which is fixedly attached to the rear wheel 22 is suddenly or abruptly stopped, the concave portion 48 of gear 40 slips or disengages from the convex portion 46 of the shaft 32 and does not perform a transmission force function. Instead, the gear 40 absorbs the rotational force of the flywheel 24. This type of action effectively prevents damage to the other component parts of the toy vehicle, and in particular the transmission gear means.

Preferably, and as best seen in FIGS. 5 and 6, the shock-absorbing means also comprises a washer 52 which is positioned on the side of the gear 40 facing the spring 50 to provide better engagement with the spring 50, to minimize wear on the gear 40 and, more particularly, to allow the gear 40 to be formed of a plastic, rather than of a metal. The spring 50, moreover, is preferably located around the center axle 32, with the gear 32 having a hub portion 53 extending from the gear side facing the spring 50 for positioning of the spring thereon.

It can be seen from the foregoing description of the toy vehicle 10 that the shock-absorbing gear means and the transmission gears connect the flywheel 24 and the rear wheel 22 so that these two components rotate in the same direction and that the shock-absorbing means, transmission gear means, and the inertia-energy flywheel are balanced within the vehicle body 12. Rotational inertia-energy is stored in the flywheel 24 when the rear wheel 22 is placed on the running surface and the toy vehicle 10 is pushed forwardly. After rotational inertia-energy has been provided to the flywheel 24, the toy vehicle can then be placed in such a manner that the rear portion 14 of the vehicle body 12 and the driven rear wheel 22 are engaged on the running surface. When this occurs, the stored rotational inertia-energy of the flywheel 24 drives the toy vehicle 10, through the shock-absorbing and transmission gear means to the rear wheel 22, forwardly in the one-wheel upwardly-extended position, as best seen in FIG. 1. This movement imparted to the toy vehicle simulates a motorcycle action commonly referred to as a "wheelie". When the stored inertia rotational energy of the flywheel 24 diminishes, the configuration and center of gravity of the toy vehicle is such that the vehicle falls forward and into its two-wheel position along the running surface.

Figure 3:
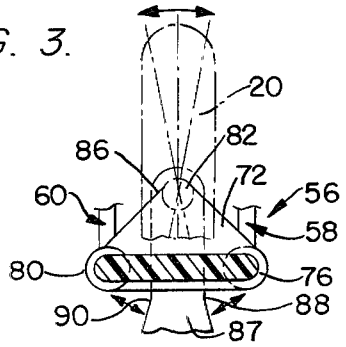
FIG. 3 is a sectional view of the toy vehicle of FIG. 1, taken along the line 3—3 in FIG. 1, illustrating the front body portion of the toy vehicle and the means for mounting the front wheel to the toy vehicle for limited lateral movement.

To ensure the above-noted proper operation of this two-wheel toy vehicle, the toy vehicle, in accordance with the invention, further comprises means for mounting the front wheel to the vehicular body for limited lateral movement. Means for restricting the lateral movement of the front wheel is provided so that the front wheel faces straight ahead when the toy vehicle is running along the running surface in its one-wheel upwardly-extended position. This prevents the vehicular body 12 from falling over in the one-wheel position. Moreover, restricting the front wheel to a straight-ahead position keeps the toy vehicle 10 from falling over when the vehicle moves from its upwardly-extended one-wheel position to its two-wheel position along the running surface. As herein embodied in the two-wheel toy vehicle in the replica of a motorcycle, and as best shown in FIGS. 2, 3, and 7, the vehicular body 12 comprises a main body frame 54 containing the flywheel 24, the transmission gear means, and the shock-absorbing means, and on which the rear wheel 22 is rotatably mounted, and a front body portion 56 pivotally mounted to the main body frame 54 for lateral movement and on which the front wheel 20 is rotatably mounted. The front wheel mounting and limiting means comprises a pair of substantially parallel shafts 58 and 60 having upper ends 62 and 64, respectively, and lower ends 66 and 68, respectively, on which the front wheel axle 16 is mounted therebetween. With the toy vehicle body 12 configured in the replica of a motorcycle, the laterally-moveable front body portion 56 forms the front portion of the motorcycle with the shafts 48 and 60 forming the forks of the motorcycle on which the front wheel and front fender are mounted.

As herein embodied, the front wheel mounting and limiting means further comprises a pair of triangular plate members 70 and 72 transversely mounted to the upper ends 62 and 64, respectively, of the shafts 58 and 60. More specifically, the corresponding back apex points of each triangular plate member 70 and 72 are attached to the shafts 58 and 60. In other words, the upper end 62 of the shaft 58 is connected to corresponding back apex points 74 and 76, respectively, of the triangular plate members 70 and 72, while the upper end 64 of the shaft 60 is connected to the corresponding back apex points 78 and 80, respectively, of the triangular plate members 70 and 72. This is best seen in FIGS. 3 and 7.

In the embodiment of the toy vehicle hereinabove described, the front wheel mounting and limiting means further comprises a third shaft 82 which is formed between the triangular plate members 70 and 72 and attached at corresponding front apex points 84 and 86, respectively, of the triangular members 70 and 72. As best seen in FIGS. 3 and 7, this third shaft 82 is substantially parallel to the shafts 58 and 60 and rotatably mounted to the main body frame 54 for providing lateral movement of the front body portion 56. A portion 87 of the main body frame extends between the shafts 58 and 60 to the shaft 82 for mounting the shaft 82 thereto. In this configuration of the front wheel mounting and limiting means, the shafts 58 and 60 abut the corresponding sides of the main body frame 54 at points 88 and 90, respectively, for limiting the lateral movement of the front body portion 56, and thus also the front wheel 20. Preferably, the portion 87 of the main body frame 54 extending between the shafts 58 and 60 is positioned between the triangular plate members 70 and 72, as best seen in FIG. 7, with the portion 87 of the main body frame 54 having a bore 92 formed therethrough for rotatably receiving the shaft 82.

It can thus be seen from the foregoing description of the front body frame portion 56 and the front wheel mounting and limiting means that when the two-wheel vehicle is configured in the replica of a motorcycle, the lateral moveable front body portion 56 forms the front portion of the motorcycle and, preferably, handlebars of the toy motorcycle are attached to one of the triangular plate members. In the embodiment illustrated in the drawings, and as best seen in FIG. 7, the motorcycle has handlebars 94 integrally formed as part of the triangular plate member 70. Assembly of the front portion of the motorcycle to the main body frame can be achieved simply and quickly with a minimum number of separate components.

In view of the foregoing described front wheel mounting and limiting means, the front wheel of the toy vehicle faces substantially straight ahead and prevents the toy vehicle from becoming unbalanced and falling over when the toy vehicle is moving forward in its one-wheel upwardly-extended position along the running surface. Moreover, the toy vehicle continues to properly run straight ahead as the toy vehicle falls from its one-wheel upwardly-extended position to its two-wheel position because the front wheel of the vehicle is being maintained in a limited straight-ahead position by the mounting and limiting means described hereinabove. Preferably, it has been found desirable to limit the lateral movement of the front wheel to an acute angle, and more particularly, to an acute angle of approximately 15 to 45 degrees. It has also been found that a limited degree of lateral or flexible movement of the front wheel and front body portion assists the toy vehicle in maintaining its forward movement and balance as the toy vehicle falls from its one-wheel upwardly-extended position to its two-wheel position along the running surface.

It can be seen from the foregoing detailed description of the embodiments of this toy vehicle that various unique and different movements can be imparted to the toy. In particular, the toy vehicle can achieve not only a forward-driven two-wheel position along the running surface, but also a forward-driven one-wheel upwardly-extended position. To operate the toy vehicle as has been described previously above, the toy vehicle 10 is repeatedly pushed in the forward direction with the rear wheel 22 along the running surface so that a strong rotational inertia energy or power is developed in the flywheel 24. After this inertia rotational energy has been provided to the flywheel 24, the toy vehicle 10 can then be positioned in an upright one-wheel position, placing the rear wheel 22 and the vehicular body rear portion 14 along the running surface, with the operator then immediately releasing the toy vehicle. When this is achieved and the momentum or power of the flywheel 24 is relatively strong, the toy vehicle 10 will move forwardly by itself in its one-wheel upwardly-extended position, as depicted in FIG. 1. When the rotational or inertia energy of the flywheel 24 diminishes to an extent, the configuration and center of gravity of the toy vehicle is such that the toy vehicle will fall forward with the front wheel 20 touching the running surface so that the toy vehicle subsequently moves forward in its two-wheel position. Of course, it is readily apparent that to ensure proper operation of the toy vehicle and this commonly-referred-to "wheelie" action and movement back to the two-wheel position of the toy vehicle, there is provided the shock-absorbing means and front wheel mounting and limiting means.

By virtue of the construction and operation of the toy vehicle in accordance with the invention, there results a two-wheel toy vehicle which is both unique, amusing and extremely entertaining. It is further seen that the toy vehicle is durable, reliable, safe, and able to withstand rough play, and one which has components easily assembled and which are of simple construction to allow low-cost, high-volume production. It will be apparent to those skilled in the art that modifications and variations can be made to the toy vehicle in accordance with the teachings of the invention without departing from the scope of the invention. Thus, it is intended that the present invention cover the modifications and variations of this invention within the scope of the appended claims and their equivalents.

What I claim is:

1. A two-wheel toy comprising:

(a) a body having a rear portion engageable with a running surface for guiding the vehicle in a forward movement along the running surface in a one-wheel upwardly-extended position;

(b) front and rear wheel axles mounted on said body;

(c) a first wheel freely rotatably mounted on said front axle and a second wheel rotatably mounted on said rear axle for driving the toy vehicle in both a one-wheel upwardly-extended position and a two-wheel position along the running surface; and, (d) inertia energy storage and drive means mounted within said body and operatively connected to said rear wheel for activation by the rotation of said rear wheel and for driving the toy vehicle through said rear wheel, wherein the vehicle is driven forwardly in a one-wheel upwardly-extended position when said driven rear wheel and said rear portion of said vehicle body are engaged on the running surface and wherein the front wheel of the vehicle returns to the running surface when the stored inertia energy diminishes, the vehicle thereby moving forwardly in a normal two-wheel position, and wherein said storage and drive means comprises an inertia flywheel rotatably mounted within said body and operatively connected to said rear wheel for rotation in the same direction and transmission gear means for transmitting rotational movement between said flywheel and said rear wheel, the gear means including a first gear fixedly connected to said rear wheel for rotation with said rear wheel about said rear axle; a second gear fixedly connected to said flywheel for rotation with said flywheel; first, second, and third gear axles mounted within said body; and third, fourth fifth, sixth and seventh gears mounted on said gear axles, said third gear being mounted on said first gear axle and meshed with said first gear, said fourth and fifth gears being commonly mounted on said second gear axle with said fourth gear meshed with said third gear, and said sixth and seventh gears commonly mounted on said third gear axle with said sixth gear meshed with said fifth gear and said seventh gear meshed with said second gear.

2. The toy vehicle of claim 1 further comprising means for mounting said front wheel to said body for limited lateral movement.

3. The toy vehicle of claim 2 wherein said body comprises a main body frame on which said rear wheel is rotatably mounted and a front body portion pivotally mounted to said main body frame for lateral movement and on which said front wheel is rotatably mounted and wherein said front wheel mounting and limiting means comprises first and second substantially parallel shafts having lower ends on which said front wheel axle is mounted therebetween, a pair of triangular plate members mounted to upper ends of said pair of shafts transverse thereto, said shafts being attached to the corresponding back apex points of each triangular plate member, and a third shaft formed between said triangular plate members at the corresponding front apex points thereof substantially parallel to said first and second shafts and rotatably mounted to said main body for lateral movement of said front body portion.

4. The toy vehicle of claim 3 wherein said main body frame extends between said first and second shafts to said third shaft for mounting said third shaft thereto and wherein said first and second shafts abut corresponding sides of said main body frame for limiting lateral movement of said front body portion.

5. The toy vehicle of claim 4 wherein said main body frame extending between said first and second shafts is positioned between said triangular plate members and has a bore formed therethrough for rotatably receiving said third shaft.

6. The toy vehicle of claims 3, 4, or 5 wherein said vehicle is configured in the form of a motorcycle, wherein said laterally movable front body portion forms the front portion of the motorcycle and wherein handle bars of said motorcycle are formed as a part of one of said triangular plate members.

7. The toy vehicle of claims 2, 3, 4, or 5 wherein said mounting and limiting means limits the lateral movement of said front wheel to an acute angle.

8. The toy vehicle of claims 2, 3, 4, or 5 wherein said mounting and limiting means limits the lateral movement of said front vehicle to an acute angle of approximately 15 to 45 degrees.

9. The toy vehicle of claim 1, 2, 3, or 4 wherein said flywheel is mounted within said body slightly closer to said rear wheel relative to said front wheel.

10. The toy vehicle of claim 1, 2, 3, or 4 wherein said flywheel is mounted within said body for positioning slightly forward of said rear wheel when said rear body portion and rear wheel engage the running surface and the vehicle is in the one-wheel upwardly-extended drive position.

11. The toy vehicle of claim 1, 2, 3, or 4 further comprising means for absorbing transmission shock forces between said flywheel and said rear wheel.

12. The toy vehicle of claim 11 wherein said shock-absorbing means is formed as a part of said transmission gear means.

13. The toy vehicle of claim 12 wherein said second gear axle comprises a center transmission shaft rotatably mounted in said body and having a conical convex portion at one end, wherein said fourth gear is fixedly mounted to said center shaft at the opposite end to said convex portion, wherein said fifth gear is rotatably mounted on said center shaft and has a conical concave portion frictionally engageable with said conical convex portion of said center shaft and wherein said shock-absorbing means comprises said second gear axle and said fourth and fifth gears and a spring positioned between said fourth and fifth gears for urging said concave and convex portions into frictional engagement.

14. The toy vehicle of claim 13 wherein said shock-absorbing means further comprises a washer positioned on the side of said fifth gear facing said spring for engagement with said spring.

15. The toy vehicle of claim 13 wherein said first, third, and fourth gears are mounted transversely to said inertia flywheel and said rear wheel at one side within said body and said second, fifth, sixth, and seventh gears are mounted transversely to said inertia flywheel and said rear wheel at the opposite side within said body.

16. A toy vehicle comprising:

(a) a body;

(b) front and rear wheels rotatably mounted to body;

(c) an inertia flywheel rotatably mounted within said body and operatively connected to said rear wheel for activation by the rotation of said rear wheel and for driving the toy vehicle along a running surface through said rear wheel;

(d) transmission gear means mounted in said body for transmitting the activation and driving forces between said inertia flywheel and said rear wheels; and (e) means for absorbing transmission shock forces positioned between said inertia flywheel and said rear wheel and formed as a part of said transmission gear means, and wherein said shock absorbing means and said transmission gear means comprises a center transmission shaft rotatably mounted in said body and having a conical convex portion at one end, a first gear operatively connected to said rear wheel and fixedly mounted to said center shaft at the opposite end to said convex portion, a second gear operatively connected to said inertia flywheel, rotatably mounted on said center shaft and having a conical concave portion frictionally engageable with said conical convex portion of said center shaft, and a spring positioned between said first and second gears for urging said concave and convex portions into frictional engagement.

17. The toy vehicle of claim 16 wherein said shock-absorbing means further comprises a washer positioned on the side of said second gear facing said spring for engagement with said spring.

18. The toy vehicle of claim 16 wherein said spring is positioned around said center shaft.

19. The toy vehicle of claims 16, wherein said flywheel and said rear wheel are operatively connected together through said shock absorbing means and transmission gear means for rotation in the same direction.

20. The toy vehicle of claims 16, 17, or 18 wherein said transmission gear means further comprises a third gear fixedly connected to said rear wheel for rotation with said rear wheel, a fourth gear rotatably mounted in said body and meshed with said first and third gears, a fifth gear fixedly connected to said inertia flywheel, a sixth gear rotatably mounted in said body and meshed with said fifth gear, and a seventh gear fixedly connected to said sixth gear along a common axis and meshed with said second gear.

21. The toy vehicle of claim 20 wherein said first, third, and fourth gears are mounted transversely to said inertia flywheel and said rear wheel at one side within said body and said second, fifth, sixth and seventh gears are mounted transversely to said inertia flywheel and said rear wheel at the opposite side within said body.

* * * * *

UNITED STATES PATENT AND TRADEMARK OFFICE

CERTIFICATE OF CORRECTION

PATENT NO. : 4,309,841

DATED : January 12, 1982

INVENTOR(S) : Kiyoji Asano

It is certified that error appears in the above—identified patent and that said Letters Patent is hereby corrected as shown below:

Front page, [30] Foreign Application Priority Date, below heading, insert --Dec. 28, 1979 [JP] Japan.....54-184337[U]--

Column 10, line 40, "claims" should be --claim--.

Signed and Sealed this

Twentieth Day of July 1982

[SEAL]

Attest:

GERALD J. MOSSINGHOFF

Attesting Officer

Commissioner of Patents and Trademarks